US011598533B2

(12) United States Patent
Chaudhry et al.

(10) Patent No.: US 11,598,533 B2
(45) **Date of Patent: *Mar. 7, 2023**

(54) HEATED WATER AVAILABILITY CONTROL

(71) Applicant: Rheem Manufacturing Company, Atlanta, GA (US)

(72) Inventors: Raheel A. Chaudhry, Montgomery, AL (US); Michael C. Mitchell, Auburn, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/681,993

(22) Filed: Feb. 28, 2022

(65) Prior Publication Data

US 2022/0178555 A1 Jun. 9, 2022

Related U.S. Application Data

(63) Continuation of application No. 16/528,369, filed on Jul. 31, 2019, now Pat. No. 11,262,084.

(51) Int. Cl.
*F24D 19/10* (2006.01)
*F24D 17/00* (2022.01)
(Continued)

(52) U.S. Cl.
CPC ..... *F24D 19/1015* (2013.01); *F24D 3/08* (2013.01); *F24D 17/0078* (2013.01);
(Continued)

(58) Field of Classification Search
CPC ... E03C 1/044; F22D 7/00; F22D 7/12; F24D 1/0018; F24D 3/08; F24D 17/0026;
(Continued)

(56) References Cited

U.S. PATENT DOCUMENTS 2,560,282 A 7/1951 Geisseler
4,848,655 A 7/1989 Woodin et al.
(Continued)

FOREIGN PATENT DOCUMENTS

CN 204574515 U 8/2015
CN 208671386 U 3/2019
WO 2014027310 A1 2/2014

OTHER PUBLICATIONS

International Search Report of International Application No. PCT/US2020/044150 dated Oct. 29, 2020.

*Primary Examiner* — Kevin F Murphy
*Assistant Examiner* — Jonathan J Waddy
(74) *Attorney, Agent, or Firm* — Eversheds Sutherland (US) LLP

(57) ABSTRACT

A water heater system includes a water heater having a first water outlet and a second water outlet. The water heater system further includes a flow detection device coupled to the first water outlet to detect a water flow through the first water outlet. The water heater system also includes a flow control valve fluidly coupled to the second water outlet. The flow control valve is configured to control a flow of water through the second water outlet based on whether the water flow through the first water outlet is detected by the flow detection device.

18 Claims, 7 Drawing Sheets

(51) Int. Cl.
*F24H 1/00* (2022.01)
*F24H 9/20* (2022.01)
*F24D 3/08* (2006.01)

(52) U.S. Cl.
CPC ..... *F24D 19/1066* (2013.01); *F24H 1/0018* (2013.01); *F24H 9/2014* (2013.01); *F24D 2220/044* (2013.01)

(58) Field of Classification Search
CPC .. F24D 17/0031; F24D 17/0078; F24D 17/02; F24D 19/1006; F24D 19/1051; F24D 19/1066; F24D 19/1069; F24D 19/1015; F24D 2220/044; F24H 1/0018; F24H 1/0027; F24H 9/0005; F24H 9/126; F24H 9/2007; F24H 9/2014; F24H 9/2021
USPC ..... 122/14.2, 14.31; 137/118.01, 118.04, 137/119.01, 119.06; 236/20 R, 25 R; 237/8 A, 8 B, 61, 62, 81
See application file for complete search history.

(56) References Cited

U.S. PATENT DOCUMENTS

| | | | | |
|---|---|---|---|---|
| 11,262,084 | B2 * | 3/2022 | Chaudhry | F24H 1/0018 |
| 2008/0083403 | A1 * | 4/2008 | King | F24D 19/1015 126/344 |
| 2011/0233290 | A1 * | 9/2011 | Borovinov | F24D 19/1015 236/93 R |
| 2011/0259322 | A1 | 10/2011 | Davis et al. | |
| 2012/0060827 | A1 * | 3/2012 | Roetker | F24D 19/1057 126/714 |
| 2014/0203093 | A1 | 7/2014 | Young et al. | |
| 2016/0211534 | A1 | 7/2016 | Ono | |
| 2016/0320075 | A1 | 11/2016 | Deivasigamani et al. | |
| 2018/0186655 | A1 | 7/2018 | Cobb et al. | |
| 2019/0041094 | A1 | 2/2019 | Chaudhry | |
| 2019/0145634 | A1 | 5/2019 | Chaudhry | |
| 2019/0285315 | A1 | 9/2019 | Chaudhry | |
| 2021/0033287 | A1 * | 2/2021 | Chaudhry | F24D 19/1015 |

* cited by examiner

HEATED WATER AVAILABILITY CONTROL

CROSS-REFERENCE TO RELATED APPLICATIONS

The present application is a continuation of, and claims priority to, U.S. patent application Ser. No. 16/528,369, filed 31 Jul. 2019, the entire content of which is incorporated herein by reference.

TECHNICAL FIELD

The present disclosure relates generally to water heaters, and more particularly to controlling the availability of heated water for water heater operations for domestic and other uses.

BACKGROUND

Some water heaters provide heated water for domestic uses as well as hydronic heating uses. For example, domestic uses may include cooking, washing, bathing, etc. To illustrate, a water heater may provide heated water to faucets, shower heads, a dishwasher, a washing machine, etc. The use of heated water for hydronic heating may reduce the amount of heated water available for domestic use. Similarly, the use of heated water for domestic purposes may reduce the amount of water available for hydronic heating. In some cases, it may be desirable to control the amount of heated water that is provided by a water heater for different uses. For example, it may be desirable to reduce or stop the availability of heated water from a water heater for hydronic heating or other auxiliary uses when heated water from the water heater is being used for domestic purposes such as bathing, etc. In some cases, it may be desirable to reduce or stop the availability of heated water for domestic use when hydronic heating or other auxiliary use is needed or preferred. Thus, a solution that enables a control of the usage of heated water from a water heater among a domestic use and hydronic/auxiliary use may be desirable.

SUMMARY

The present disclosure relates generally to water heaters, and more particularly to controlling water heater operations for domestic and hydronic/auxiliary usage. In some example embodiments, a water heater system includes a water heater having a first water outlet and a second water outlet. The water heater system further includes a flow detection device coupled to the first water outlet to detect a water flow through the first water outlet. The water heater system also includes a flow control valve fluidly coupled to the second water outlet. The flow control valve is configured to control a flow of water through the second water outlet based on whether the water flow through the first water outlet is detected by the flow detection device.

In some example embodiments, a heated water system includes a water heater system that includes a water heater having a first water outlet and a second water outlet. The water heater system further includes a flow detection device coupled to the first water outlet to detect a water flow through the first water outlet. The water heater system also includes a flow control valve fluidly coupled to the second water outlet and configured to control a flow of water through the second water outlet based on whether the water flow through the first water outlet is detected by the flow detection device. The heated water system further includes a pump fluidly coupled to the second outlet of the water heater to circulate water from the water heater through a hydronic heating system and back to the water heater through a recirculation water inlet of the water heater.

In some example embodiments, a water heater flow control method includes detecting, by a flow detection device, a water flow through a first water outlet of a water heater. The method further includes receiving, by a controller, a flow detection signal that indicates whether the water flow through the first water outlet is detected by the flow detection device. The method also includes controlling, by the controller, a flow control valve based on the flow detection signal, wherein the flow control valve is coupled to a second water outlet of the water heater.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
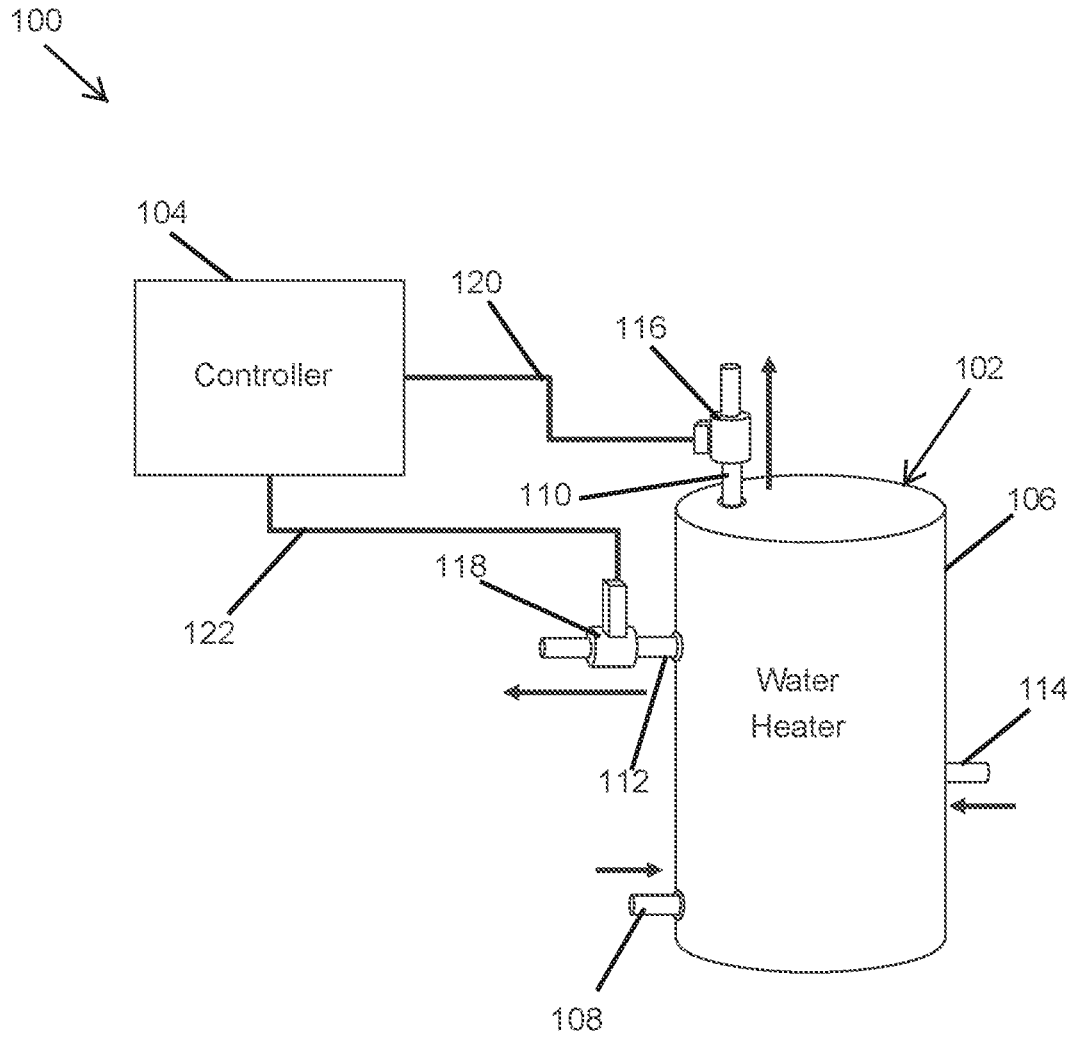
FIG. 1 illustrates a water heater system including a water heater according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates a water heater system 100 including a water heater 102 according to an example embodiment. In some example embodiments, the system 100 may include a controller 104 that controls operations of the system 100 in general and may also control some operations of the water heater 102. The water heater 102 may be a gas-fired water heater, an electric water heater, or another type of water heater that can receive cold water, heat the cold water, and provide heated water for domestic use (e.g., cooking, washing, bathing, etc.) as well as other uses such as hydronic heating of a space. The water heater 102 may include components not shown in FIG. 1, such a burner, a blower, a thermostat, and/or other components, as can be readily understood by those of ordinary skill in the art with the benefit of this disclosure.

In some example embodiments, the water heater 102 may include a water supply inlet 108, and a domestic-use water outlet 110. For example, the water heater 102 may receive cold water from a municipality or another water source through the water supply inlet 108 and heat the water. To illustrate, the heating of the cold water by the water heater 102 may be controlled by a thermostat setting of the water heater 102. The water heater 102 may include a heat exchanger and/or other components that may be included in and/or outside of the water heater 102 as can be readily understood by those of ordinary skill in the art with the benefit of this disclosure. The water heater 102 may provide the heated water for domestic use through the domestic-use water outlet 110.

In some example embodiments, the water heater 102 may also include a hydronic-use water outlet 112 and a recirculation water inlet 114. For example, the water heater 102 may provide some of the heated water through the hydronic-use water outlet 112 for hydronic heating. The heated water that leaves the water heater 102 via the hydronic-use water outlet 112 may be recirculated back into the water heater 102 via the recirculation water inlet 114. In some case, the use of the heated water for hydronic use via the hydronic-use water outlet 112 may have a lower priority than the use of the heated water for domestic use via the domestic-use water outlet 110.

In some example embodiments, a flow switch 116 may be coupled to the domestic-use water outlet 110. For example, the flow switch 116 may be fluidly or otherwise coupled to the domestic-use water outlet 110 to detect a water flow from the water heater 102 through the domestic-use water outlet 110. The flow switch 116 may be coupled to the controller 104 via an electrical connection 120 and may provide to the controller 104 a flow detection signal that indicates whether a flow of water through the domestic-use water outlet 110 is detected by the flow switch 116. The flow switch 116 may generate the flow detection signal in a manner known to those of ordinary skill in the art with the benefit of this disclosure.

In some example embodiments, a flow control valve 118 may be coupled to the hydronic-use water outlet 112. For example, the flow control valve 118 may be an electronic flow control valve as can be readily understood by those of ordinary skill in the art with the benefit of this disclosure. The flow control valve 118 may be fluidly or otherwise coupled to the domestic-use water outlet 110 to control a flow of water through the hydronic-use water outlet 112 based on whether water flow through the domestic-use water outlet 110 is detected by the flow switch 116. To illustrate, the flow control valve 118 may be coupled to the controller 104 via an electrical connection 122 and may provide the control signal to the flow control valve 118 via the electrical connection 122.

In some examples, the controller 104 may control operations of the flow control valve 118 based on whether the flow detection signal from the flow switch 116 indicates a detection of a flow of water through the domestic-use water outlet 110. To illustrate, the controller 104 may determine from the flow detection signal that water is flowing through the domestic-use water outlet 110 from the water heater 102. In response to the detection of the water flow through the domestic-use water outlet 110, the controller 104 may use the control signal provided to the flow control valve 118 to close the flow control valve 118 or otherwise prevent a flow of water from the water heater 102 through the hydronic-use water outlet 112. For example, the flow control valve 118 may be an on-off flow control valve, such as an actuated ball valve. In response to determining that the flow detection signal from the flow switch 116 indicates that no water is flowing through the domestic-use water outlet 110, the controller 104 may use the control signal provided to the flow control valve 118 to open the flow control valve 118 or otherwise allow the flow of water through the hydronic-use water outlet 112.

In some alternative embodiments, instead of providing a control signal to fully close or open the flow control valve 118, the controller 104 may provide the control signal to the flow control valve 118 to adjust the flow of water through the hydronic-use water outlet 112. For example, in response to determining that the flow detection signal from the flow switch 116 indicates that water is flowing through the domestic-use water outlet 110, the controller 104 may use the control signal provided to the flow control valve 118 to reduce the flow of water through the hydronic-use water outlet 112. As another example, in response to determining that the flow detection signal from the flow switch 116 indicates that no water is flowing through the domestic-use water outlet 110, the controller 104 may use the control signal provided to the flow control valve 118 to increase the flow of water through the hydronic-use water outlet 112, for example, by increasing the opening of the flow control valve 118.

In some example embodiments, the controller 104 may include one or more microcontrollers, microprocessors, or another integrated circuit component (e.g., an FPGA) that execute a software code stored in one or more non-transitory memory devices to perform the functions of the controller 104. For example, the controller 104 may include or may be communicably coupled to a non-volatile memory device containing executable software code and data. In some example embodiments, the controller 104 may include other components such as an analog-to-digital converter, a digital-to-analog converter, etc. as can be readily understood by those of ordinary skill in the art with the benefit of this disclosure.

By controlling the availability of heated water for hydronic heating based on the need for heated water for domestic use, the system 100 allows the domestic use of heated water to have a higher priority than the hydronic use of the heated water. To illustrate, by stopping or reducing the flow of heated water for hydronic heating purposes through the hydronic-use water outlet 112 when heated water is needed for domestic use, the system 100 may allow more heated water to be available for domestic use. By allowing or increasing the flow of heated water for hydronic heating purposes through the hydronic-use water outlet 112 when heated water is not needed for domestic use, the system 100 may allow more heated water to be available for hydronic heating.

In some example embodiments, the system 100 may include one or more other components without departing from the scope of this disclosure. For example, the system 100 may include a power supply to provide electrical power to the controller. In some example embodiments, the water heater 102 may be a tankless water heater. In some alternative embodiments, the water tank 102 may have a different shape than shown without departing from the scope of this disclosure. In some alternative embodiments, the inlets 108, 114 and the outlets 110, 112 may be at different locations than shown without departing from the scope of this disclosure. In some example embodiments, one or more of the inlets 108, 114 and the outlets 110, 112 may be have shorter or longer than shown without departing from the scope of this disclosure. For example, one or more of the inlets 108, 114 and the outlets 110, 112 may be flush with an outer shell 106 of the water heater 102. In some alternative embodiments, the controller 104 may be physically attached to the water heater 102.

In some example embodiments, the water heater 102 may provide heated water through the hydronic-use water outlet 112 for other purposes in addition to or instead of hydronic heating without departing from the scope of this disclosure. In some alternative embodiments, the recirculation water inlet 114 may be omitted, where the heated water that leaves the water heater 102 through the hydronic-use water outlet 112 is not recirculated back to the water heater 102. In some alternative embodiments, the flow switch 116 and the flow control valve 118 may have different shapes and may be at different locations relative to the shell 106 without departing from the scope of this disclosure. In some alternative embodiments, instead of the flow switch 116, a different type of a flow detection device may be used without departing from the scope of this disclosure.

Figure 2:
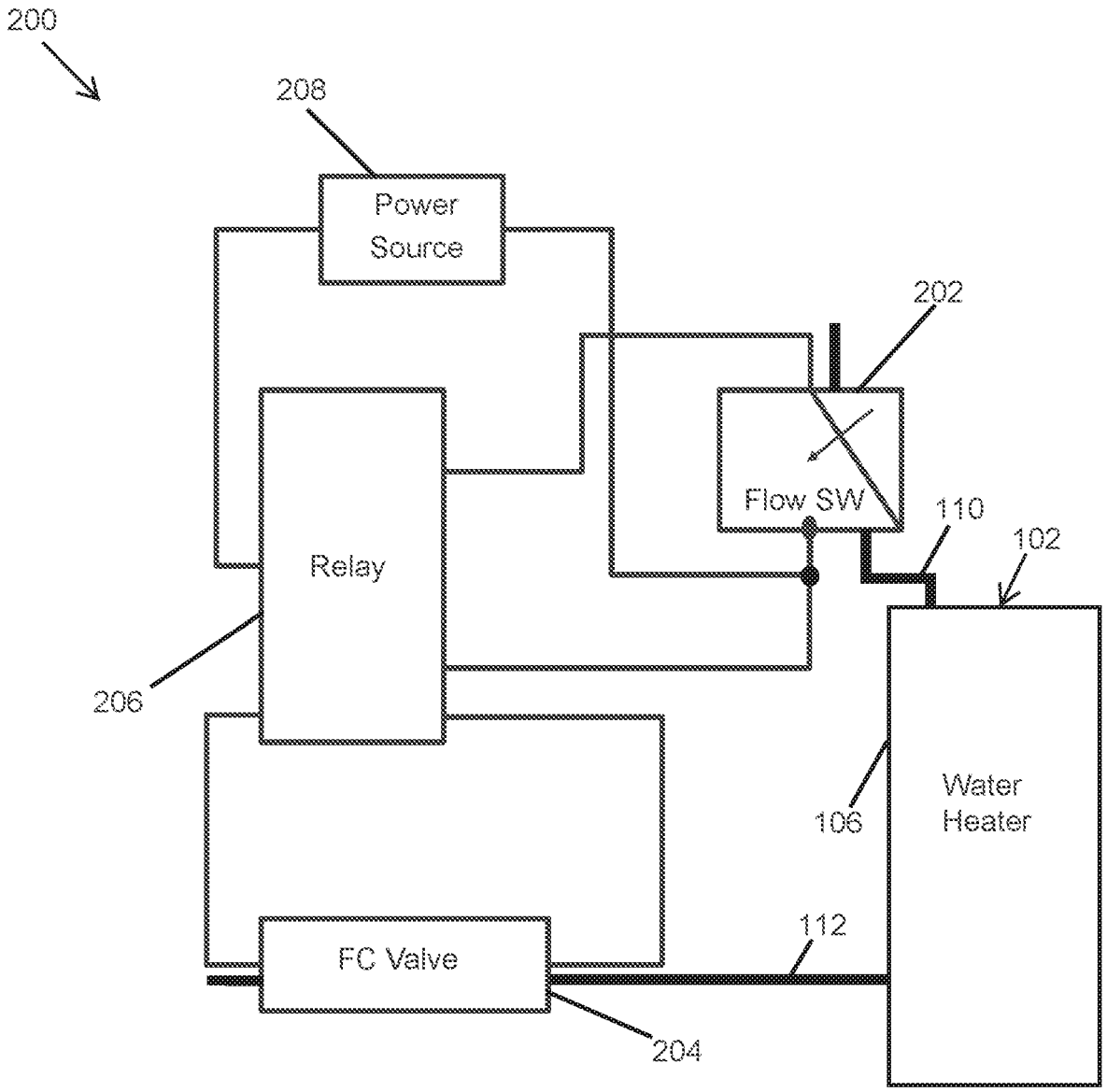
FIG. 2 illustrates a water heater system according to another example embodiment.

FIG. 2 illustrates a water heater system 200 according to another example embodiment. In some example embodiments, the system 200 includes a flow switch 202, a flow control valve 204, a relay 206, and a power source 208 (e.g., a battery such as a 12-V battery). For example, the flow switch 202 may correspond to the flow switch 116 shown in FIG. 1 and may be coupled to the domestic-use water outlet 110 in a similar manner. The flow control valve 204 may correspond to the flow control valve 118 shown in FIG. 1 and may be coupled to the hydronic-use water outlet 112 in a similar manner.

In some example embodiments, the relay 206 may be hardwired as shown in FIG. 2, where a polarity of electrical power provided by the power source 208 is controlled by the relay 206 based on whether a flow of water through the domestic-use water outlet 110 is detected by the flow switch 202. To illustrate, when the flow switch 202 is closed in response to a flow of water through the domestic-use water outlet 110, the electrical power from the power source 208 may be provided to the flow control valve 204 through the relay 206 in a particular polarity that results in the flow control valve 204 being closed. When the flow control valve 204 is closed, heated water may be prevented from flowing out from the water heater 102 through the hydronic-use water outlet 112. When water is not flowing through the domestic-use water outlet 110, the flow switch 202 may be open, where the polarity of the electrical power from the power source 208 is reversed to open the flow control valve 204.

In some alternative embodiments, the flow switch 202 may be open when water flows through the domestic-use water outlet 110, and the flow switch 202 may be closed when is not flowing through the domestic-use water outlet 110. To illustrate, when the flow switch 202 is open, the polarity of the electrical power provided to the flow control valve 204 through the relay 206 may be such that the flow control valve 204 is closed, thus preventing heated water from flowing out from the water heater 102 through the hydronic-use water outlet 112. When the flow switch 202 is closed indicating that no water is flowing through the domestic-use water outlet 110, the polarity of the electrical power provided to the flow control valve 204 through the relay 206 may be such that the flow control valve 204 is open, thus allowing heated water to flow out from the water heater 102 through the hydronic-use water outlet 112.

In some alternative embodiments, instead of changing the polarity of the electrical power based on whether a flow of water through the domestic-use water outlet 110 is indicated by the flow switch 202, different voltage levels may be provided to the flow control valve 204 through the relay 206. For example, a first voltage level (e.g., 12 volts) may correspond to the detection of a flow of water through the domestic-use water outlet 110 and may result in the flow control valve 204 being closed and thus preventing the flow of heated water out of the hydronic-use water outlet 112. Another voltage level (0 volt) may correspond to no water flow through the domestic-use water outlet 110 and may result in the flow control valve 204 being open and thus allowing the flow of heated water out of the hydronic-use water outlet 112.

By controlling the availability of heated water for hydronic heating based on the need for heated water for domestic use, the system 200 allows the domestic use of heated water from the water heater 102 to have a higher priority than the hydronic use of the heated water.

In some example embodiments, the system 200 may include one or more other components without departing from the scope of this disclosure. In some alternative embodiments, instead of the flow switch 116, a different type of a flow detection device may be used without departing from the scope of this disclosure. In some example embodiments, the water heater 102 may provide heated water through the hydronic-use water outlet 112 for other purposes in addition to or instead of hydronic heating without departing from the scope of this disclosure.

Figure 3:
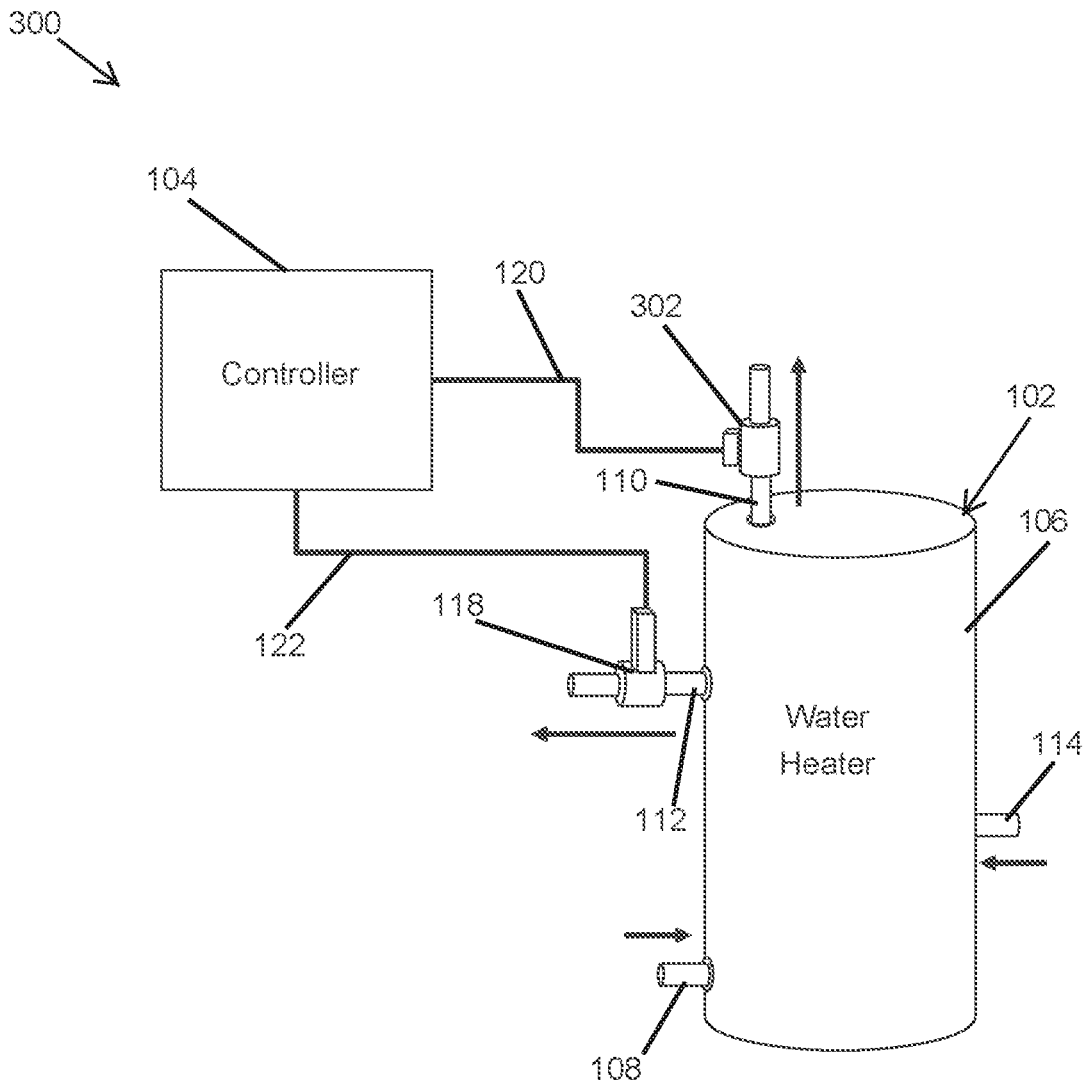
FIG. 3 illustrates a water heater system according to another example embodiment.

FIG. 3 illustrates a water heater system 300 according to another example embodiment. Referring to FIGS. 1 and 3, the water heater system 300 is substantially similar to the water heater system 100. Focusing on the primary differences, in contrast to the water heater system 100 that uses the flow switch 116 as a flow detection device, the water heater system 300 uses a flow sensor 302 as a flow detection device. To illustrate, the flow sensor 302 may be coupled to the domestic-use water outlet 110 of the water heater 102 to detect the flow of water from the water heater 102 through the domestic-use water outlet 110.

In some example embodiments, the flow sensor 302 may be coupled to the controller 104 via the electrical connection 120 and may provide to the controller 104 a flow detection signal that is indicative of a volume of the water flow through the domestic-use water outlet 110. The flow detection signal may indicate the volume of the water flow through the domestic-use water outlet 110 in a manner readily understood by those of ordinary skill in the art with the benefit of this disclosure. For example, changes in the amplitude of the flow detection signal may indicate changes in the amount of water flowing through the domestic-use water outlet 110.

In some example embodiments, the controller 104 may control the flow control valve 118 based on the flow detection signal from the flow sensor 302. For example, when the flow detection signal indicates no water flow from the water heater 102 through the domestic-use water outlet 110, the controller 104 may use the control signal provided to the flow control valve 118 via the electrical connection 122 to fully open the flow control valve 118 or otherwise allow heated water to freely flow out from the water heater 102 through the hydronic-use water outlet 112. When the flow detection signal indicates some amount of water flow from the water heater 102 through the domestic-use water outlet 110, the controller 104 may use the control signal provided to the flow control valve 118 to correspondingly restrict the flow of heated water from the water heater 102 through the hydronic-use water outlet 112.

In some example embodiments, when the flow detection signal indicates a large volume of water flow from the water heater 102 through the domestic-use water outlet 110, the controller 104 may use the control signal to close the flow control valve 118 or otherwise prevent the flow of heated water from the water heater 102 through the hydronic-use water outlet 112. The relationship between the flow detection signal from the flow sensor 302 and the corresponding control of the flow control switch 118 may be set or adjusted, for example, based on a desired allocation of heater water for domestic use and hydronic use as can be readily understood by those of ordinary skill in the art with the benefit of this disclosure.

By controlling the volume of heated water available for hydronic heating based on the level of domestic use of heated water, the system 300 allows the domestic use of heated water from the water heater 102 to have a higher priority than the hydronic use of the heated water.

In some example embodiments, the system 300 may include one or more other components without departing from the scope of this disclosure. In some alternative embodiments, instead of the flow sensor 302, a different type of flow detection device may be used without departing from the scope of this disclosure. In some example embodiments, the controller 104 may consider the amount of additional heat that can be used to further heat the water in the water heater 102 in controlling the flow control valve 118 to adjust the volume of heated water flow through the hydronic-use water outlet 112. In some example embodiments, the water heater 102 may provide heated water through the hydronic-use water outlet 112 for other purposes in addition to or instead of hydronic heating without departing from the scope of this disclosure.

Figure 4:
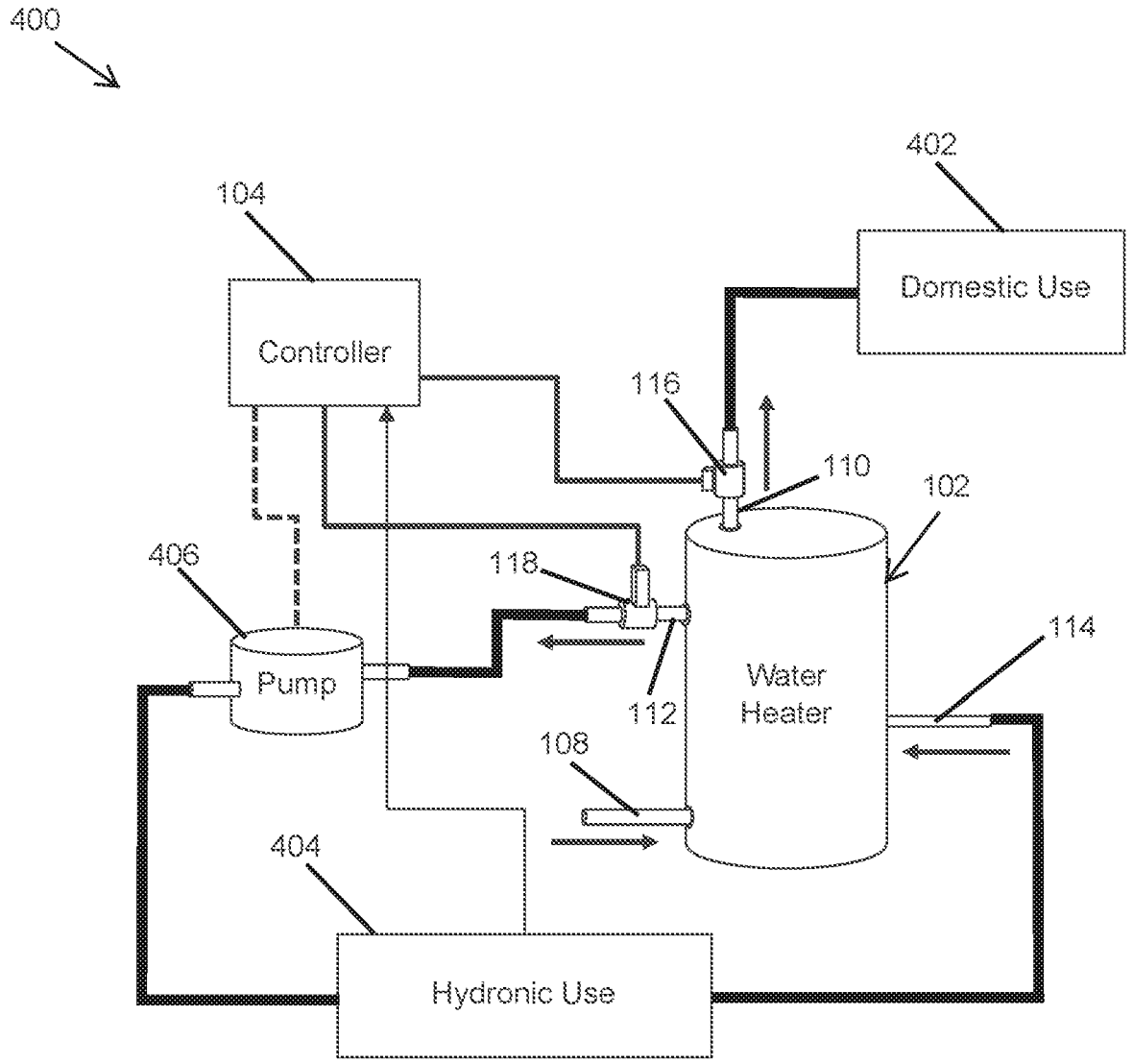
FIG. 4 illustrates a heated water system including the water heater of FIG. 1 according to an example embodiment.

FIG. 4 illustrates a heated water system 400 including the water heater 102 of FIG. 1 according to an example embodiment. Referring to FIGS. 1 and 4, in some example embodiments, the heated water system 400 includes the water heater 102, the controller 104, a domestic-use system 402, and a hydronic-use system 404. The domestic-use system 402 is fluidly coupled to the domestic-use water outlet 110 of the water heater 102, and the hydronic-use system 404 is fluidly coupled to the hydronic-use water outlet 112 of the water heater 102 through a pump 406 that may recirculate heated water back to the water heater 102 through the recirculation water inlet 114.

In some example embodiments, cold water that enters the water heater 102 through the water supply inlet 108 may be heated by the water heater 102, and the heated water may be provided to the domestic-use system 402 and the hydronic-use system 404. For example, the domestic-use system 402 may include a kitchen sink, a bathroom sink, a dishwasher, a bathtub, a shower, etc., and the hydronic-use system 404 may include heat transfer piping, etc.

In some example embodiments, when heated water from the water heater 102 is used in the domestic-use system 402, the controller 104 may control the use of heated water by the hydronic-use system 404 by controlling the flow of heated water through the hydronic-use water outlet 112 in a similar manner as described with respect to the system 100 of FIG. 1. For example, when the flow switch 116 indicates the flow of water from the water heater 102 to the domestic use system 402 through the domestic-use water outlet 110, the controller 104 may control flow control valve 118 to prevent the flow of heated water from the water heater 102 to the hydronic-use system 404 through the hydronic-use water outlet 112. When the flow switch 116 indicates the no flow of water from the water heater 102 to the domestic use system 402 through the domestic-use water outlet 110, the controller 104 may control flow control valve 118 to allow the flow of heated water from the water heater 102 to the hydronic-use system 404 through the hydronic-use water outlet 112.

In some example embodiments, when the flow switch 116 indicates the flow of water from the water heater 102 to the domestic use system 402 through the domestic-use water outlet 110, the controller 104 may control flow control valve 118 to reduce, without stopping, the flow of heated water from the water heater 102 to the hydronic-use system 404 through the hydronic-use water outlet 112. When the flow switch 116 indicates no flow of water from the water heater 102 to the domestic use system 402 through the domestic-use water outlet 110, the controller 104 may control flow control valve 118 to increase the flow of heated water from the water heater 102 to the hydronic-use system 404 through the hydronic-use water outlet 112.

In some example embodiments, the controller 104 may control the operation of the pump 406. For example, when the controller 104 closes the flow control valve 118 or otherwise prevents the flow of heated water from the water heater 102 through the hydronic-use water outlet 112, the controller 104 may shut off the pump 406 to prevent dead heading that may occur if the recirculation piping does not include a bypass path. The controller 104 may also control the operations of the pump 406, for example, based on a thermostat that operates based on a temperature of a room that is heated hydronic use system 404.

In some alternative embodiments, the heated water system 400 may include the water heater system 200 of FIG. 2 instead of the water heater system 100. When the heated water system 400 includes the system 200 instead of the system 100, the controller 104 may be omitted, and the system 200 may control the use of heated water by the hydronic-use system 404 by controlling the flow of heated water through the hydronic-use water outlet 112 in a similar manner as described with respect to the system 200 of FIG. 2.

In some alternative embodiments, the heated water system 400 may include the water heater system 300 of FIG. 3 instead of the water heater system 100. When the heated water system 400 includes the system 300 instead of the system 100, the flow sensor 302 of FIG. 3 is used instead of the flow switch 116 to detect the flow of water through the domestic-use water outlet 110. The controller 104 may control the use of heated water by the hydronic-use system 404 by controlling the flow of heated water through the hydronic-use water outlet 112 in a similar manner as described with respect to the system 300 of FIG. 3. For example, the controller 104 may adjust the volume of heated water provided to the hydronic-use system 404 through the hydronic-use water outlet 112 by controlling the flow control valve 118 based on the volume of water flow through the domestic-use water outlet 110 indicated by the water detection signal from the flow sensor 302.

In some alternative embodiments, the system 400 may include other components without departing from the scope of this disclosure. In some alternative embodiments, some of the heated water provided for domestic use may be recirculated without departing from the scope of this disclosure. In some alternative embodiments, a device other than the pump 406 may be used to control recirculation of water through the domestic-use system 404 without departing from the scope of this disclosure. In some example embodiments, the water heater 102 may provide heated water through the hydronic-use water outlet 112 for other purposes in addition to or instead of hydronic heating without departing from the scope of this disclosure.

Figure 5:
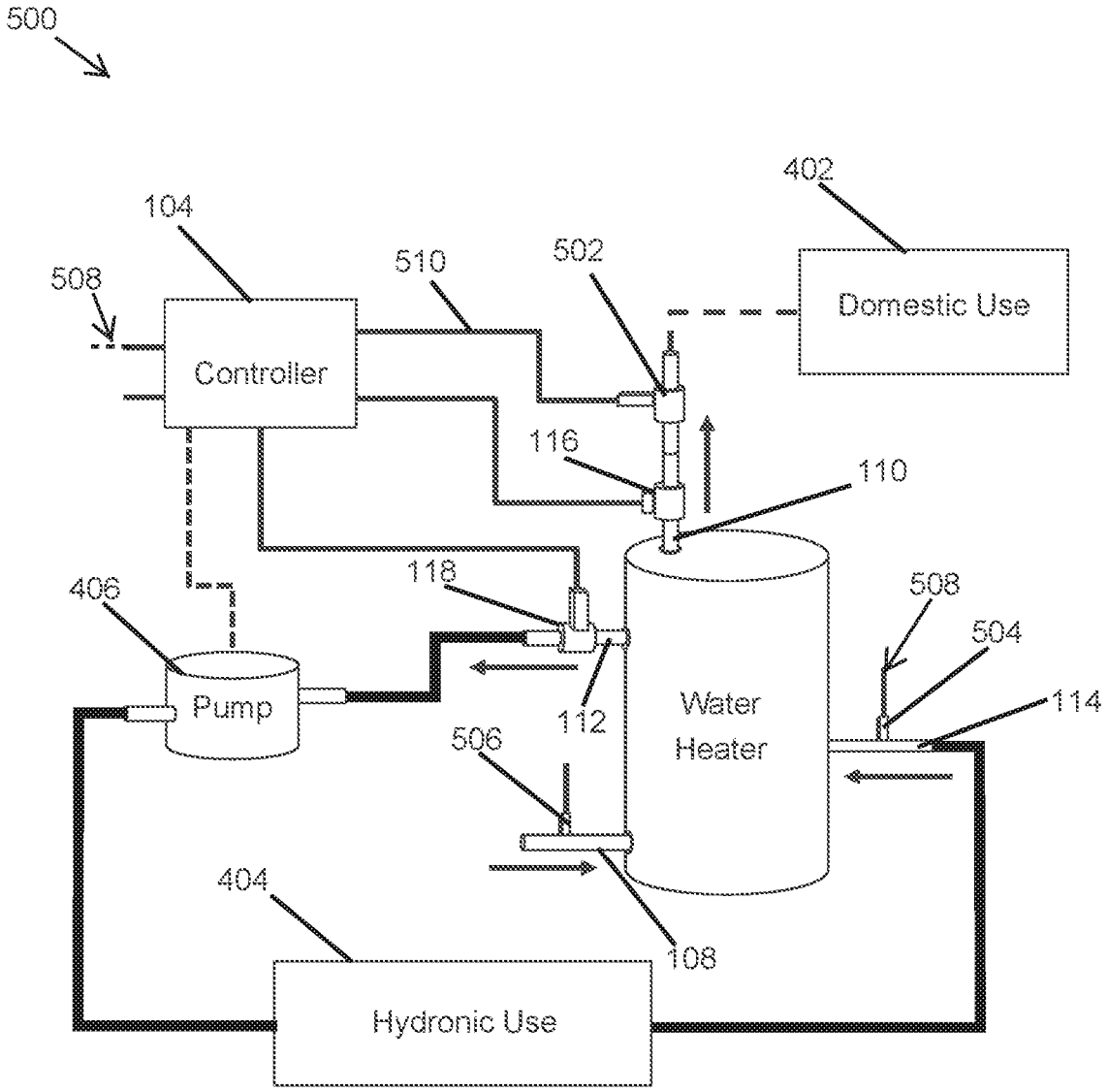
FIG. 5 illustrates a heated water system according to another example embodiment.

FIG. 5 illustrates a heated water system 500 according to another example embodiment. Referring to FIGS. 1, 4, and 5, in some example embodiments, the heated water system 500 includes the water heater 102, the controller 104, a domestic-use system 402, and a hydronic-use system 404. The domestic-use system 402 is fluidly coupled to the domestic-use water outlet 110 of the water heater 102, and the hydronic-use system 404 is fluidly coupled to the hydronic-use water outlet 112 of the water heater 102 through a pump 406 that may recirculate heated water back to the water heater 102 through the recirculation water inlet 114.

In some example embodiments, cold water that enters the water heater 102 through the water supply inlet 108 may be heated by the water heater 102, and the heated water may be provided to the domestic-use system 402 and the hydronic-use system 404. In some example embodiments, when the flow switch 116 indicate the flow of heated water from the water heater 102 to the domestic-use system 402, the controller 104 may adjust the flow of heated water to the hydronic-use system 404 by controlling the flow control valve 118 in a similar manner as described above with respect to the system 100 of FIG. 1 and the system 400 of FIG. 4. In some alternative embodiments, the system 500 may operate to control the flow of heated water through the hydronic-use water outlet 112 in a similar manner as described with respect to the system 300 of FIG. 3 and the system 400 of FIG. 4 when the system 500 includes the flow sensor 302 instead of the flow switch 116. In some example embodiments, the controller 104 may control the operation of the pump 406 in a similar manner as described above.

As shown in FIG. 5, in some example embodiments, a flow control valve 502 may be fluidly coupled to the domestic-use water outlet 110 to control the flow of heated water from the water heater 102 through the domestic-use water outlet 110. To illustrate, a temperature sensor 504 may be coupled to the recirculation piping of the system 500 to monitor the temperature of the water that is passes through the hydronic-use system 404 and returns to the water heater 102 via the recirculation water inlet 114. For example, the temperature sensor 504 may be located at or proximal to the recirculation water inlet 114. The temperature sensor 504 may indicate the temperature of the recirculated water, for example, via an electrical connection 508 that is connected to the controller 104.

In some example embodiments, the controller 104 may control the flow control valve 502 based on the temperature sensed by the temperature sensor 504 to adjust the flow of heated water from the water heater 102 through the domestic-use water outlet 110. For example, the controller 104 may provide a control signal to the flow control valve 502 via an electrical connection 510 to control the operations of the flow control valve 502. The controller 104 may also control the flow control valve 118 based on the temperature sensed by the temperature sensor 504 to adjust the flow of heated water from the water heater 102 through the hydronic-use water outlet 112. To illustrate, if the temperature sensor 504 senses a temperature that is below a threshold temperature (e.g., 33° F.), the controller 104 may control the flow control valve 502 to decrease the flow of heated water through the domestic-use water outlet 110 and may control the flow control valve 118 to increase the flow of heated water through the hydronic-use water outlet 112. By increasing the water flow through the hydronic-use water outlet 112 based on the temperature information provided by the temperature sensor 504, the freezing of water in or after the hydronic-use 404, which can result in damages to various components, may be avoided.

In some example embodiments, the controller 104 may control the flow control valve 502 and/or the control valve 118 based on the temperature sensed by a temperature sensor 506 instead of or in addition to the temperature sensed by the temperature sensor 504. For example, the temperature sensor 506 may be located proximal to the water supply inlet 108 and may sense the temperature of the supply water that is provided to the water heater 102 via the water supply inlet 108. To illustrate, the controller 104 may control flow the control valve 118 to decrease or increase the flow of heated water through the hydronic-use water outlet 112 based on the temperature sensed by the temperature sensor 506. The controller 104 may alternatively or in addition control flow the control valve 502 to decrease or increase the flow of heated water through the domestic-use water outlet 110 based on the temperature sensed by the temperature sensor 506.

In some example embodiments, the controller 104 may control the flow control valves 118, 502 to adjust the flows of heated water through the domestic-use water outlet 110 and the hydronic-use water outlet 112 only if the water heater 102 cannot provide additional heated water to the domestic-use system 402 or to the hydronic-use system 404 without reducing the volume of heated water provide to one of the two systems. 402, 404. In some example embodiments, when the temperature sensed by the temperature sensor 504 is below a threshold temperature (e.g., 35° F., 40 F, etc.), the controller 104 may reduce the volume of heated water that is provided to the hydronic-use system 404 even when no domestic use of heated water is detected by the flow switch 116 (or by the flow sensor 302 or another flow detection device).

In some alternative embodiments, the system 500 may include other components without departing from the scope of this disclosure. In some alternative embodiments, some of the heated water provided for domestic use may be recirculated without departing from the scope of this disclosure. In some alternative embodiments, a device other than the pump 406 may be used to control recirculation of water through the domestic-use system 404 without departing from the scope of this disclosure. In some example embodiments, the water heater 102 may provide heated water through the hydronic-use water outlet 112 for other purposes in addition to or instead of hydronic heating without departing from the scope of this disclosure.

Figure 6:
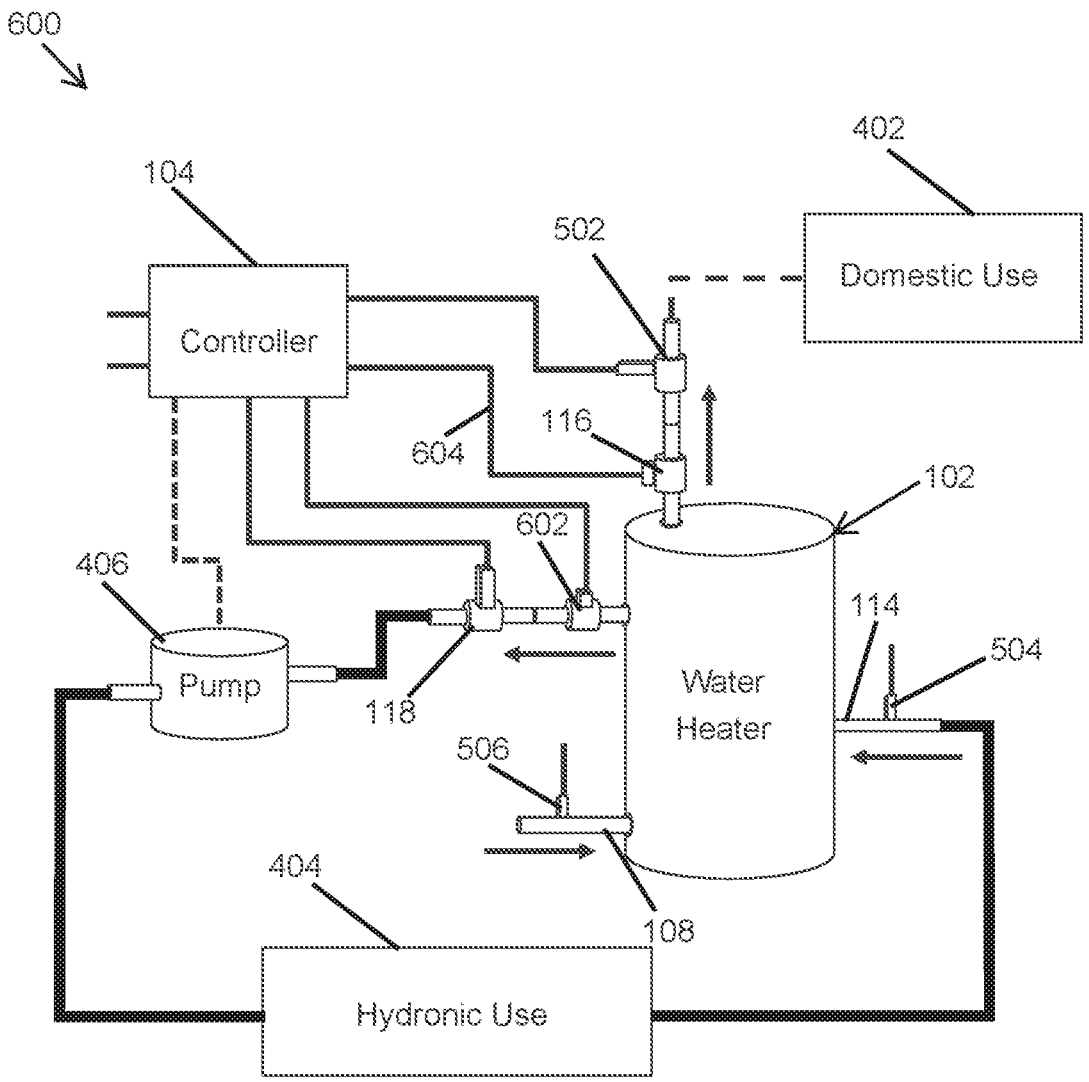
FIG. 6 illustrates a heated water system according to another example embodiment.

FIG. 6 illustrates a heated water system 600 another example embodiment. Referring to FIGS. 1, 4, 5, and 6, in some example embodiments, the heated water system 600 includes the water heater 102, the controller 104, a domestic-use system 402, and a hydronic-use system 404. The domestic-use system 402 is fluidly coupled to the domestic-use water outlet 110 of the water heater 102, and the hydronic-use system 404 is fluidly coupled to the hydronic-use water outlet 112 of the water heater 102 through a pump 406 that may recirculate heated water back to the water heater 102 through the recirculation water inlet 114.

In some example embodiments, cold water that enters the water heater 102 through the water supply inlet 108 may be heated by the water heater 102, and the heated water may be provided to the domestic-use system 402 and the hydronic-use system 404. In some example embodiments, when the flow switch 116 indicate the flow of heated water from the water heater 102 to the domestic-use system 402, the controller 104 may adjust the flow of heated water to the hydronic-use system 404 by controlling the flow control valve 118 in a similar manner as described above with respect to the systems 100, 400, 500. In some alternative embodiments, the system 500 may operate to control the flow of heated water through the hydronic-use water outlet 112 in a similar manner as described with respect to the systems 300, 400, 500 when the system 600 includes the flow sensor 302 instead of the flow switch 116. In some example embodiments, the controller 104 may control the operation of the pump 406 in a similar manner as described above.

In some example embodiments, the controller 104 may control the flow control valve 502 based on the temperature sensed by the temperature sensor 504 and/or the temperature sensed by the temperature sensor 506 to adjust the flow of heated water through the domestic-use water outlet 110 in a similar manner as described with respect to the system 500 of FIG. 5. The controller 104 may also control the flow control valve 118 based on the temperature sensed by the temperature sensor 504 and/or the temperature sensed by the temperature sensor 506 to adjust the flow of heated water through the hydronic-use water outlet 112 in a similar manner as described with respect to the system 500 of FIG. 5.

As shown in FIG. 6, in some example embodiments, a flow sensor 602 may be coupled to the hydronic-use water outlet 112 to detect the flow of heated water from the water heater 102 through the hydronic-use water outlet 112. To illustrate, the flow sensor 602 may provide to the controller 104, via an electrical connection 604, a flow detection signal that that is indicative of a volume of water flow through the hydronic-use water outlet 112. The flow sensor 602 may generate the flow detection signal in a manner known to those of ordinary skill in the art with the benefit of this disclosure. The controller 104 may control the flow control valve 118 and/or the flow control valve 502 based on the flow detection signal from the flow sensor 602, the flow detection signal from the flow switch 116 (or from the flow sensor 302), the temperature sensed by the temperature sensor 504, and/or the temperature sensed by the temperature sensor 506. For example, the controller 104 may reduce the volume of water flow through the hydronic-use water outlet 112 based on the volume of water flow indicated by the flow sensor 602 if the temperature sensed by the temperature sensor 504 is below a threshold temperature.

In some example embodiments, the controller 104 may control the flow control valves 118, 502 to adjust the flows of heated water through the domestic-use water outlet 110 and the hydronic-use water outlet 112 only if the water heater 102 cannot provide additional heated water to the domestic-use system 402 or to the hydronic-use system 404 without reducing the volume of heated water provide to one of the two systems. 402, 404. In some example embodiments, when the flow of heated water from the water heater 102 increases to a total volume that exceeds the maximum volume of adequately heated water that can be provided by the water heater 102, the controller 104 may reduce the volume of heated water that is provided to the domestic-use system 402, the hydronic-use system 404, or both. In some example embodiments, when the temperature sensed by the temperature sensor 504 is below a threshold temperature (e.g., 35° F., 40 F, etc.), the controller 104 may reduce the volume of heated water that is provided to the hydronic-use system 404 even when no domestic use of heated water is detected by the flow switch 116 (or by the flow sensor 302 or another flow detection device).

In some alternative embodiments, the system 600 may include other components without departing from the scope of this disclosure. In some alternative embodiments, some of the heated water provided for domestic use may be recirculated without departing from the scope of this disclosure. In some alternative embodiments, a device other than the pump 406 may be used to control recirculation of water through the domestic-use system 404 without departing from the scope of this disclosure. In some example embodiments, the water heater 102 may provide heated water through the hydronic-use water outlet 112 for other purposes in addition to or instead of hydronic heating without departing from the scope of this disclosure.

Figure 7:
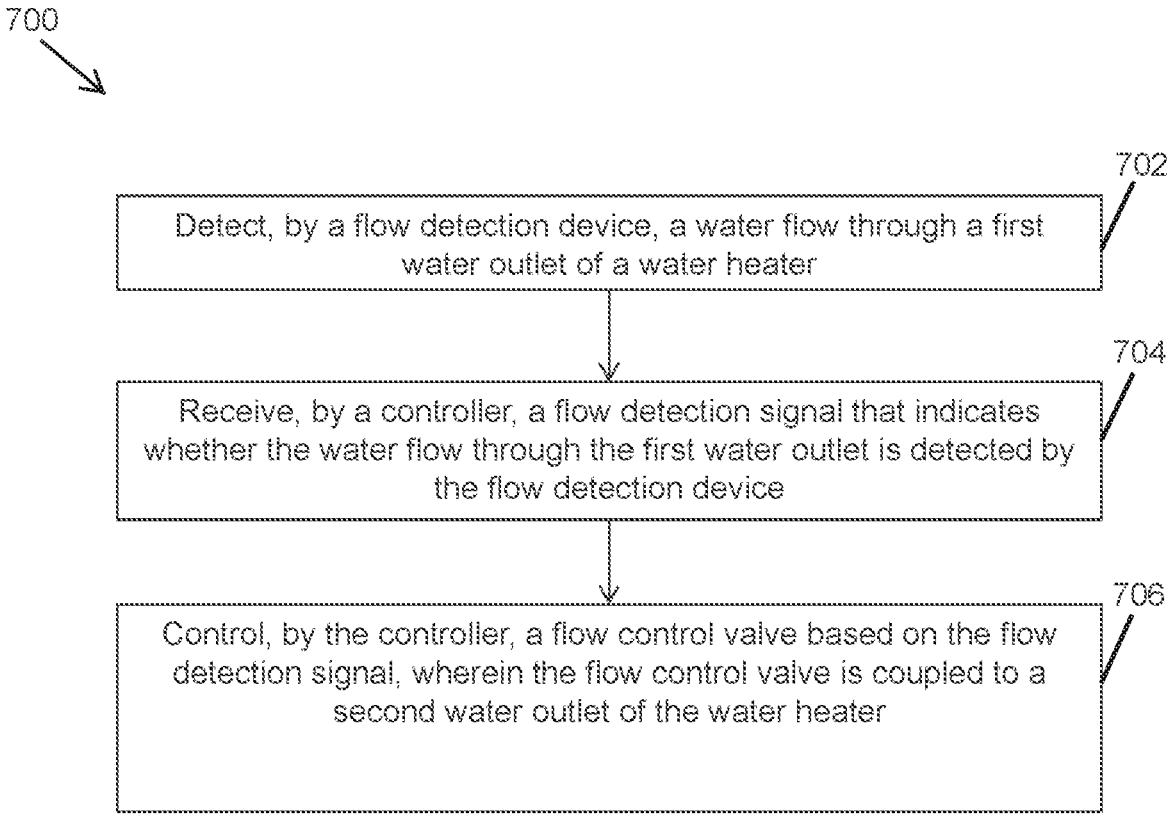
FIG. 7 illustrates a method of controlling the availability of heated water from a water heater according to another example embodiment.

FIG. 7 illustrates a method 700 of controlling the availability of heated water from a water heater such as the water heater of FIGS. 1-6 according to another example embodiment. Referring to FIGS. 1-7, in some example embodiments, at step 702, the method 700 may include detecting, by a flow detection device, a water flow through a first water outlet of a water heater. For example, the flow switch 116 or the flow sensor 302 may detect water flow from the water heater 102 through the domestic-use water outlet 110. At step 704, the method 700 may include receiving, by a controller, a flow detection signal that indicates whether the water flow through the first water outlet is detected by the flow detection device. For example, the controller 104 may receive from the flow detection device, such as the flow switch 116 or the flow sensor 302, the flow detection signal indicating whether the water flow through the domestic-use water outlet 110 is detected by the flow detection device.

In some example embodiments, at step 706, the method 700 may include controlling, by the controller 104, a flow control valve, such as the flow control valve 118, based on the flow detection signal. As described above, the flow control valve is coupled to hydronic-use water outlet 112 of the water heater 102. The controller 102 may control the flow control valve 118 based on the flow detection signal by providing a command to the flow control valve to close the flow control valve 118 if the flow detection signal indicates a detection of the water flow through the domestic-use water outlet 110. The flow control valve 118 may prevent a flow of water through the hydronic-use water outlet 112 when the flow control valve 118 is closed.

In some example embodiments, the method 700 may include controlling, by the controller 102, the flow control valve 118 based on the flow detection signal by providing a command to the flow control valve 118 to open the flow control valve 118 if the flow detection signal from the flow detection device indicates that water flow through the domestic-use water outlet 110 is not detected. The method 700 may also include controlling, by the controller 102, a second flow control valve (e.g., the flow control valve 502) fluidly coupled to the flow detection device at least based on a temperature of hydronic-use water returning to the water heater through the recirculation water inlet 114.

In some example embodiments, the method 700 may include controlling, by the controller 104, the flow of heated water through the first water outlet, such as the domestic-use water outlet 110, based on the temperature of the of hydronic-use water returning to the water heater 102 through the recirculation water inlet 114. The controller 104 may also control the flow of heated water through the hydronic-use water outlet 112 based on the temperature of the of hydronic-use water returning to the water heater 102 through the recirculation water inlet 114.

In some example embodiments, one or more steps of the method 700 may be omitted without departing from the scope of this disclosure. In some example embodiments, the method 700 may include additional steps without departing from the scope of this disclosure. In some example embodiments, some of the steps of the method 700 may be performed in a different order than described above without departing from the scope of this disclosure.

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A water heater flow control method, comprising:

detecting, by a flow detection device, a water flow through a first water outlet of a water heater; and controlling, by a controller and based on the water flow through the first water outlet of the water heater, a flow control valve coupled to a second water outlet of the water heater to (i) at least partially close the flow control valve if water flow is detected through the first water outlet or (ii) at least partially open the flow control valve if no water flow is detected through the first water outlet.

2. The method of claim 1, further comprising controlling, by the controller, a second flow detection device fluidly coupled to the second water outlet to detect water flow through the second water outlet, wherein the controller is configured to control a second flow control valve based on at least a temperature of hydronic-use water returning to the water heater through a recirculation water inlet.

3. A water heater system configured to provide heated water to a domestic use system and a hydronic heating system, comprising:

a water heater having a first water outlet in communication with the domestic use system and a second water outlet in communication with the hydronic heating system;

a flow detection device coupled to the first water outlet to detect a water flow through the first water outlet; and a flow control valve fluidly coupled to the second water outlet and configured to control a flow of water through the second water outlet based on whether the water flow through the first water outlet is detected by the flow detection device.

4. The water heater system of claim 3, further comprising a controller communicably coupled to the flow detection device and to the flow control valve, wherein the controller is configured to control the flow control valve based on a flow detection signal to control the flow of water through the second water outlet, wherein the flow detection device is configured to provide the flow detection signal that indicates whether the water flow through the first water outlet is detected.

5. The water heater system of claim 4, wherein the flow detection device is a flow switch.

6. The water heater system of claim 5, wherein the controller is configured to close the flow control valve if the flow detection signal indicates a detection of the water flow through the first water outlet and wherein the controller is configured to open the flow control valve if the flow detection signal indicates no detection of the water flow through the first water outlet.

7. The water heater system of claim 4, wherein the flow detection device is a flow sensor and wherein the flow detection signal is indicative of a volume of the water flow through the first water outlet.

8. The water heater system of claim 7, wherein the controller is configured to control the flow control valve to adjust the flow of water through the second water outlet based on the flow detection signal.

9. The water heater system of claim 4, wherein the flow control valve is an on-off flow control valve.

10. The water heater system of claim 4, further comprising a second flow detection device fluidly coupled to the second water outlet to detect water flowing through the second water outlet to the hydronic heating system.

11. The water heater system of claim 10, further comprising a second flow control valve fluidly coupled to the first water outlet to control water flowing through the first water outlet to the domestic use system based on whether water flow through the second water outlet is detected by the second flow detection device.

12. The water heater system of claim 3, further comprising a power source and a relay, wherein a power from the power source is provided to the flow control valve through the relay depending on whether the water flow through the first water outlet is detected by the flow detection device.

13. A heated water system configured to provide heated water to a domestic use system and a hydronic heating system, comprising:

a water heater system comprising:

a water heater having a first water outlet in communication with the domestic use system and a second water outlet in communication with the hydronic heating system;

a flow detection device coupled to the first water outlet to detect a water flow through the first water outlet; and a flow control valve fluidly coupled to the second water outlet and configured to control a flow of water through the second water outlet based on whether the water flow through the first water outlet is detected by the flow detection device; and a pump fluidly coupled to the second water outlet of the water heater to circulate water from the water heater through the hydronic heating system and back to the water heater through a recirculation water inlet of the water heater.

14. The heated water system of claim 13, further comprising a controller communicably coupled to the flow detection device and to the flow control valve, wherein the controller is configured to control the flow control valve based on a flow detection signal to control the flow of water through the second water outlet, wherein the flow detection device is configured to provide the flow detection signal that indicates whether the water flow through the first water outlet is detected.

15. The heated water system of claim 14, wherein the flow detection device is a flow switch.

16. The heated water system of claim 14, wherein the flow detection device is a flow sensor and wherein the flow detection signal depends on a volume of the water flow through the first water outlet.

17. The heated water system of claim 14, further comprising a second flow control valve fluidly coupled to the flow detection device, wherein the flow detection device is positioned between the first water outlet and the second flow control valve.

18. The heated water system of claim 13, further comprising a power source and a relay, wherein a power from the power source is provided to the flow control valve through the relay depending on whether the water flow through the first water outlet is detected by the flow detection device.

* * * * *